US012208826B2

(12) United States Patent
Reitz et al.

(10) Patent No.: US 12,208,826 B2
(45) **Date of Patent: *Jan. 28, 2025**

(54) MECHANISM FOR LONGITUDINAL DOOR SYSTEMS

(71) Applicant: Trinity Rail Group, LLC, Dallas, TX (US)

(72) Inventors: Lee A. Reitz, Euless, TX (US); Kenneth W. Huck, Fairview, TX (US)

(73) Assignee: TRINITY RAIL GROUP, LLC, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/336,659

(22) Filed: Jun. 16, 2023

(65) Prior Publication Data

US 2024/0075966 A1 Mar. 7, 2024

Related U.S. Application Data

(63) Continuation of application No. 16/989,255, filed on Aug. 10, 2020, now Pat. No. 11,702,113, which is a continuation of application No. 15/938,601, filed on Mar. 28, 2018, now Pat. No. 10,773,734.

(60) Provisional application No. 62/479,004, filed on Mar. 30, 2017.

(51) Int. Cl.

| | |
|---|---|
| ***B61D 7/02*** | (2006.01) |
| ***B61D 7/08*** | (2006.01) |
| ***B61D 7/28*** | (2006.01) |

(52) U.S. Cl.
CPC ..... *B61D 7/02* (2013.01); *B61D 7/08* (2013.01); *B61D 7/28* (2013.01)

(58) Field of Classification Search
CPC ... B61D 7/00; B61D 7/02; B61D 7/04; B61D 7/08; B61D 7/14; B61D 7/16; B61D 7/18; B61D 7/20; B61D 7/24; B61D 7/26; B61D 7/28
See application file for complete search history.

(56) References Cited

U.S. PATENT DOCUMENTS

| | | | | |
|---|---|---|---|---|
| 3,868,913 | A | 3/1975 | Becker | |
| 10,773,734 | B2 | 9/2020 | Reitz | |
| 11,702,113 | B2 * | 7/2023 | Reitz | B61D 7/02 105/251 |

* cited by examiner

*Primary Examiner* — Robert J McCarry, Jr.
(74) *Attorney, Agent, or Firm* — Baker Botts L.L.P.

(57) ABSTRACT

A railway car is disclosed. The railway car comprises an underframe and at least one compartment for transporting lading. The railway car comprises at least one discharge opening and a door assembly adjacent to the at least one discharge opening. The railway car comprises a discharge control system comprising at least a common linkage mounted away from a longitudinal centerline of the railway car and a secondary linkage, wherein the discharge control system is operable to move the door assembly between a first position and a second position. The railway car comprises an actuator operable to drive movement of the common linkage in connection with movement of the door assembly between the first position and the second position.

21 Claims, 10 Drawing Sheets

MECHANISM FOR LONGITUDINAL DOOR SYSTEMS

PRIORITY

This application is a continuation, under 35 U.S.C. § 120, of U.S. patent application Ser. No. 16/989,255 filed on Aug. 10, 2020, which is a continuation, under 35 U.S.C. § 120, of U.S. patent application Ser. No. 15/938,601 filed on Mar. 28, 2018, now U.S. Pat. No. 10,773,734, which claims the benefit under 35 U.S.C. § 119(e) of the priority of U.S. Provisional Application 62/479,004 filed on Mar. 30, 2017, entitled "Mechanism for Longitudinal Door Systems," all of which are hereby incorporated by reference in their entirety.

TECHNICAL FIELD

The present disclosure relates, in general, to railcars and more particularly to railcars that discharge cargo or lading, such as coal, ore, ballast, grain and any other lading suitable for transportation in railcars.

BACKGROUND

Railway cars have been used for many years to transport and sometimes store dry, bulk materials. Hopper cars (which have one or more hoppers), for example, are frequently used to transport coal, sand, metal ores, ballast, aggregates, grain and any other type of lading which may be satisfactorily discharged through respective openings formed in one or more hoppers.

Hopper cars may be classified as open or closed. Hopper cars may have relatively short sidewalls and end walls or relatively tall or high sidewalls and end walls. The sidewalls and end walls of many hopper cars are typically reinforced with a plurality of vertical side stakes. The sidewalls and end walls are typically formed from steel or aluminum sheets. Some hopper cars include interior frame structures or braces to provide additional support for the sidewalls.

Applicable standards of the Association of American Railroads (AAR) established maximum total weight on rail for any railcar including box cars, freight cars, hopper cars, gondola cars, and temperature-controlled cars within prescribed limits of length, width, height, etc. All railway cars operating on commercial rail lines in the U.S. must have exterior dimensions that satisfy associated AAR clearance plates. Therefore, the maximum load that may be carried by any railcar is typically limited by the applicable AAR clearance plate and empty weight of the railcar. Reducing the empty weight of a railcar or increasing the interior dimensions may increase both volumetric capacity and maximum load capacity of a railcar while still meeting applicable AAR standards for total weight on rail and clearance plate.

Railway cars often include one or more discharge openings. Hopper cars, for example, often include respective discharge openings at or near the bottom of each hopper to rapidly discharge cargo. As another example, gondola cars may have one or more discharge openings in a sidewall assembly of the gondola car. These discharge openings often have associated door and/or gate assemblies. A variety of door assemblies and gate assemblies along with various operating mechanisms have been used to open and close discharge openings associated with railway cars. There may be certain disadvantages associated with existing door assemblies and/or gate assemblies. For example, according to one existing approach, longitudinal door systems are operated by a pneumatic cylinder and drive beam located along the longitudinal centerline of the car. Although such an arrangement is suitable for some railcar operators, others may find that the placement of the discharge control system along the longitudinal centerline of the car may limit the purposes for which such a railcar may be used.

Thus, there is a need for an improved longitudinal door mechanism.

SUMMARY

To address the foregoing problems with existing solutions, disclosed is a railway car. The railway car comprises an underframe and at least one compartment for transporting lading. The railway car comprises at least one discharge opening and a door assembly adjacent to the at least one discharge opening. The railway car comprises a discharge control system comprising at least a common linkage mounted away from a longitudinal centerline of the railway car and a secondary linkage, wherein the discharge control system is operable to move the door assembly between a first position and a second position. The railway car comprises an actuator operable to drive movement of the common linkage in connection with movement of the door assembly between the first position and the second position.

In certain embodiments, the underframe may comprise a side sill oriented parallel to a longitudinal axis of the railway car. The at least one compartment for transporting lading may comprise at least one hopper. The at least one discharge opening may be formed proximate to a lower portion of the at least one hopper. The common linkage may be mounted to the side sill. In certain embodiments, the common linkage may comprise a torque tube, and the actuator may be operable to rotate the torque tube in a clockwise direction relative to a longitudinal axis of the torque tube and in a counterclockwise direction relative to the longitudinal axis of the torque tube. In certain embodiments, the common linkage may comprise a sliding beam, and the actuator may be operable to push the sliding beam relative to the longitudinal axis of the railway car and pull the sliding beam relative to the longitudinal axis of the railway car.

In certain embodiments, the railway car may further comprise at least one sidewall assembly coupled to the underframe. The at least one discharge opening may be formed in the at least one sidewall assembly. The common linkage may be mounted proximate to a top chord coupled to the at least one sidewall assembly. In certain embodiments, the common linkage may comprise a torque tube, and the actuator may be operable to rotate the torque tube in a clockwise direction relative to a longitudinal axis of the torque tube and in a counterclockwise direction relative to the longitudinal axis of the torque tube. In certain embodiments, the common linkage may comprise a sliding beam, and the actuator may be operable to push the sliding beam relative to the longitudinal axis of the railway car and pull the sliding beam relative to the longitudinal axis of the railway car.

Also disclosed is a railway car. The railway car comprises an underframe, the underframe comprising a center sill located at a longitudinal centerline of the railway car and defining a longitudinal axis of the railway car. The railway car comprises at least one compartment for transporting lading. The railway car comprises a first discharge opening and a second discharge opening. The railway car comprises a first door assembly adjacent to the first discharge opening, and a second door assembly adjacent to the second discharge opening. The railway car comprises a first discharge control system comprising a first common linkage mounted away from the longitudinal centerline of the railway car, the first common linkage coupled to a first secondary linkage coupled to the first door assembly, wherein the first discharge control system is operable to open and close the first door assembly. The railway car comprises a second discharge control system comprising a second common linkage mounted away from the longitudinal centerline of the railway car, the second common linkage coupled to a second secondary linkage coupled to the second door assembly, wherein the second discharge control system is operable to open and close the second door assembly. The railway car comprises a first actuator operable to drive movement of the first common linkage in connection with opening and closing the first door assembly. The railway car comprises a second actuator operable to drive movement of the second common linkage in connection with opening and closing the second door assembly.

In certain embodiments, the underframe may comprise a first side sill and a second side sill, the first side sill and the second side sill extending generally parallel with the center sill and spaced laterally from opposite sides of the center sill. The at least one compartment for transporting lading may comprise at least one hopper. The first discharge opening may be formed proximate to a lower portion of the at least one hopper. The second discharge opening may be formed proximate to the lower portion of the at least one hopper. The first common linkage may be mounted to the first side sill. The second common linkage may be mounted to the second side sill. In certain embodiments, the first common linkage may comprise a first torque tube mounted to an underside of the first side sill using a first hanger support. The second common linkage may comprise a second torque tube mounted to an underside of the second side sill using a second hanger support. The first actuator may be operable to rotate the first torque tube in a clockwise direction relative to a longitudinal axis of the first torque tube and in a counterclockwise direction relative to the longitudinal axis of the first torque tube. The second actuator may be operable to rotate the second torque tube in a clockwise direction relative to a longitudinal axis of the second torque tube and in a counterclockwise direction relative to the longitudinal axis of the second torque tube. In certain embodiments, the first common linkage may comprise a first sliding beam. The first secondary linkage may comprise a first arm. The second common linkage may comprise a second sliding beam. The second secondary linkage may comprise a second arm. The first actuator may be operable to push the first sliding beam relative to the longitudinal axis of the railway car and pull the first sliding beam relative to the longitudinal axis of the railway car. The second actuator may be operable to push the second sliding beam relative to the longitudinal axis of the railway car and pull the second sliding beam relative to the longitudinal axis of the railway car.

In certain embodiments, the railway car may further comprise at least one sidewall assembly coupled to the underframe. The first discharge opening may be formed in the at least one sidewall assembly. The second discharge opening may be formed in the at least one sidewall assembly. The first common linkage may be mounted above the first discharge opening proximate to a top chord coupled to the at least one sidewall assembly. The second common linkage may be mounted above the second discharge opening proximate to the top chord coupled to the at least one sidewall assembly. In certain embodiments, the first common linkage may comprise a first torque tube. The second common linkage may comprise a second torque tube. The first actuator may be operable to rotate the first torque tube in a clockwise direction relative to a longitudinal axis of the first torque tube and in a counterclockwise direction relative to the longitudinal axis of the first torque tube. The second actuator may be operable to rotate the second torque tube in a clockwise direction relative to a longitudinal axis of the second torque tube and in a counterclockwise direction relative to the longitudinal axis of the second torque tube.

In certain embodiments, the first actuator and the second actuator may be configured to operate independently such that each of the first door assembly and the second door assembly can be separately opened and closed.

Also disclosed is a method of forming a railway car. The method comprises forming a railcar underframe. The method comprises forming at least one compartment for transporting lading. The method comprises forming at least one discharge opening. The method comprises mounting a door assembly adjacent to the at least one discharge opening. The method comprises mounting, away from a longitudinal centerline of the railway car, at least a portion of a common linkage of a discharge control system, the common linkage coupled to a secondary linkage coupled to the door assembly, wherein the discharge control system is operable to move the door assembly between a first position and a second position. The method comprises installing an actuator operable to drive movement of the common linkage of the discharge control system in connection with movement of the door assembly between the first position and the second position.

In certain embodiments, the underframe may comprise a side sill oriented parallel to a longitudinal axis of the railway car. The at least one compartment for transporting lading may comprise at least one hopper. The at least one discharge opening may be formed proximate to a lower portion of the at least one hopper. The common linkage may be mounted to the side sill. In certain embodiments, the common linkage may comprise a torque tube, and the actuator may be operable to rotate the torque tube in a clockwise direction relative to a longitudinal axis of the torque tube and in a counterclockwise direction relative to the longitudinal axis of the torque tube. In certain embodiments, the common linkage may comprise a sliding beam, and the actuator may be operable to push the sliding beam relative to the longitudinal axis of the railway car and pull the sliding beam relative to the longitudinal axis of the railway car.

In certain embodiments, the method may further comprise forming at least one sidewall assembly coupled to the underframe. The at least one discharge opening may be formed in the at least one sidewall assembly. The common linkage may be mounted proximate to a top chord coupled to the at least one sidewall assembly. In certain embodiments, the common linkage may comprise a torque tube, and the actuator may be operable to rotate the torque tube in a clockwise direction relative to a longitudinal axis of the torque tube and in a counterclockwise direction relative to the longitudinal axis of the torque tube. In certain embodiments, the common linkage may comprise a sliding beam, and the actuator may be operable to push the sliding beam relative to the longitudinal axis of the railway car and pull the sliding beam relative to the longitudinal axis of the railway car.

Certain embodiments may have one or more technical advantages. For example, certain embodiments may increase flexibility for railcar operators in terms of placement of a discharge control system. As another example, the various embodiments described herein may advantageously allow discharge openings on a railway car to be opened one at a time instead of at the same time. As another example, certain embodiments may advantageously facilitate maintenance and service because of the location of components of the discharge control system (e.g., relative to the side sill in hopper cars or relative to the top chord in gondola cars). As another example, certain embodiments may advantageously enable a larger discharge opening to be used, increasing the speed and efficiency with which cargo can be unloaded. Additionally, placing elements of the discharge control system for a hopper car on the side sill may advantageously permit the longitudinal gates to open away from the center sill of the railway hoper car. During unloading, this may advantageously direct lading toward the center of the car, reducing the amount of lading that may spill over the rail.

BRIEF DESCRIPTION OF THE DRAWINGS

For a more complete understanding of the disclosed embodiments and their features and advantages, reference is now made to the following description, taken in conjunction with the accompanying drawings, in which.

DETAILED DESCRIPTION

Figure 1:
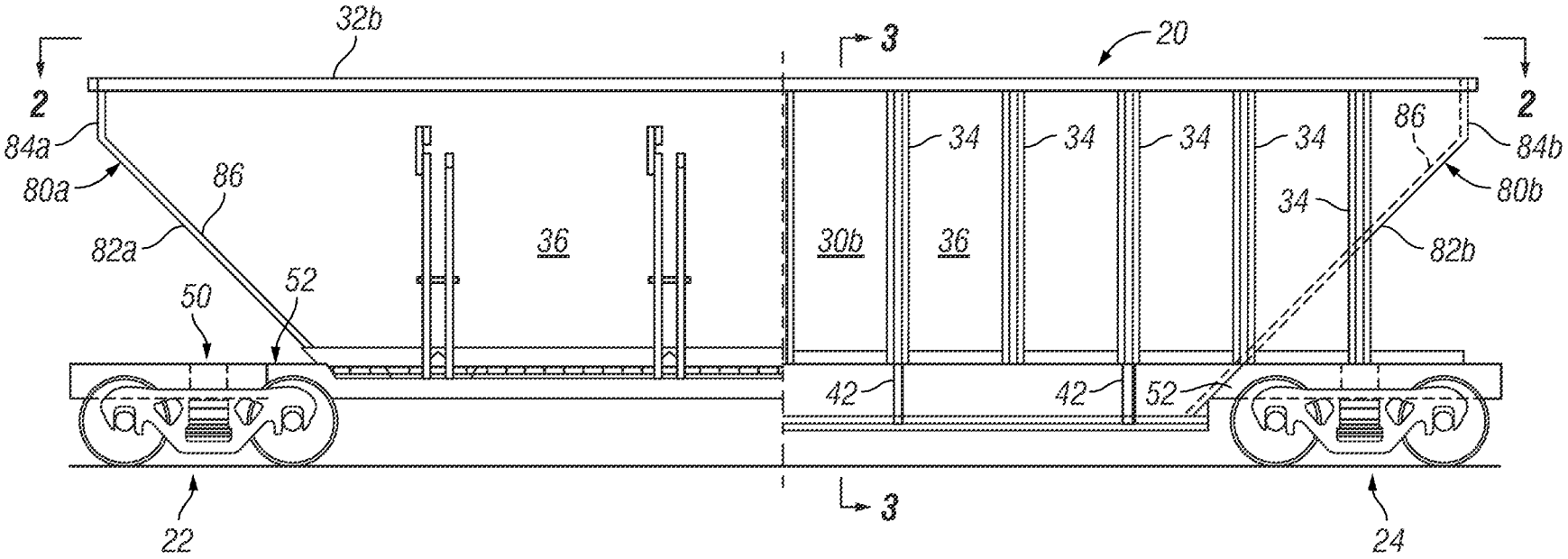
FIG. 1 is a schematic drawing in elevation with portions broken away showing a side view of a railway car, in accordance with certain embodiments.

As described above, railway cars with one or more discharge openings may be used to transport and sometimes store dry, bulk materials. Hopper cars, for example, are frequently used to transport coal, sand, metal ores, ballast, aggregates, grain and any other type of lading that may be satisfactorily discharged through respective openings formed in one or more hoppers. In hopper cars, respective discharge openings are typically provided at or near the bottom of each hopper to rapidly discharge cargo. In gondola cars, the discharge opening may be provided in the sidewall assembly. A variety of discharge control systems have been used to open and close discharge openings associated with railway cars. There are, however, certain disadvantages associated with existing discharge control systems.

For example, according to one existing approach, longitudinal door systems are operated by a pneumatic cylinder and drive beam located along the longitudinal centerline of the car. Although such an arrangement may be suitable for some railcar operators, others may find that the placement of the discharge control system along the longitudinal centerline of the car may limit the purposes for which such a railcar may be used. In such a scenario, it may be desirable to relocate the discharge control system for the longitudinal door system.

The present disclosure contemplates various embodiments that may address these and other deficiencies associated with existing approaches. In some cases, this is achieved by locating a discharge control system for operating a longitudinal door such that it is positioned away from the longitudinal centerline of the railcar. According to one example embodiment, a railway car is disclosed. The railway car comprises an underframe and at least one compartment for transporting lading. The railway car comprises at least one discharge opening, and a door assembly adjacent to the at least one discharge opening. The railway car comprises a discharge control system comprising at least a common linkage mounted away from a longitudinal centerline of the railway car and a secondary linkage. The discharge control system is operable to move the door assembly between a first position and a second position. The railway car comprises an actuator operable to drive movement of the common linkage in connection with movement of the door assembly between the first position and the second position.

In certain embodiments, the underframe may comprise a side sill oriented parallel to a longitudinal axis of the railway car. The at least one compartment for transporting lading may comprise at least one hopper, and the at least one discharge opening may be formed proximate to a lower portion of the at least one hopper. In such a scenario, the common linkage may be mounted to the side sill.

In certain embodiments, the railway car may comprise at least one sidewall assembly coupled to the underframe. The at least one discharge opening may be formed in the at least one sidewall assembly. In such a scenario, the common linkage may be mounted proximate to a top chord coupled to the at least one sidewall assembly.

In certain embodiments, the common linkage may comprise a torque tube. In such a scenario, the actuator may be operable to rotate the torque tube in a clockwise direction relative to a longitudinal axis of the torque tube and in a counterclockwise direction relative to the longitudinal axis of the torque tube. In certain embodiments, the common linkage may comprise a sliding beam. In such a scenario, the actuator may be operable to push the sliding beam relative to the longitudinal axis of the railway car and pull the sliding beam relative to the longitudinal axis of the railway car. In certain embodiments, the actuator may comprise one of: a hydraulic actuator; a pneumatic actuator; and a manual actuator. In certain embodiments, the actuator may be mounted on the side sill.

Certain embodiments may have one or more technical advantages. For example, certain embodiments may increase flexibility for railcar operators in terms of placement of a discharge control system. As another example, the various embodiments described herein may advantageously allow discharge openings on a railway car to be opened one at a time instead of at the same time. As another example, certain embodiments may advantageously facilitate maintenance and service because of the location of components of the discharge control system (e.g., relative to the side sill in hopper cars or relative to the top chord in gondola cars). As another example, certain embodiments may advantageously enable a larger discharge opening to be used, increasing the speed and efficiency with which cargo can be unloaded. Additionally, placing elements of the discharge control system for a hopper car on the side sill may advantageously permit the longitudinal gates to open away from the center sill of the railway hoper car. During unloading, this may advantageously direct lading toward the center of the car, reducing the amount of lading that may spill over the rail.

FIG. 1 is a schematic drawing in elevation with portions broken away showing a side view of a railway car, in accordance with certain embodiments. Various features of the embodiments disclosed herein will be described with respect to hopper car 20, which may be satisfactorily used to carry coal and any other suitable types of lading. Hopper car 20 may have any suitable dimensions. For example, in certain embodiments hopper car 20 may have a length between truck centers of forty (40) feet six (6) inches; a length over strikers of fifty (50) feet two and one half (2½) inches; and a length over pulling faces of fifty-three (53) feet and one (1) inch. In certain embodiments, hopper car 20 may have any suitable dimensions. Hopper car 20 may be satisfactorily used to carry bulk materials such as coal and other types of lading. Examples of additional lading include, but are not limited to, sand, grain, metal ores, aggregate and ballast.

Hopper car 20 may be generally described as an open hopper car with bottom discharge openings or outlets. Respective door assemblies or gates may be opened and closed to control discharge of lading from the discharge openings or outlets of hopper car 20. However, the various embodiments described herein are not limited to open hopper cars or hopper cars that carry coal. For example, the various embodiments described herein may be advantageously applied to gondola cars (as described below in relation to FIG. 12), closed hopper cars, articulate hopper cars, hopper cars that carry grain or any other type of hopper car and ballast car. Examples of lading carried by such hopper cars may include, but are not limited to, corn distillers dried grains (DDG), corn condensed distillers solubles (CDS), corn distillers dried grains/solubles (DDGS) and wet distillers grain with solubles (WDGS). Such products are frequently associated with ethanol production from corn and/or other types of grain.

In the example embodiment of FIG. 1, hopper car 20 includes a pair of sidewall assemblies 30*a* (not shown due to the portions broken away) and 30*b*. As shown in FIG. 1, sidewall assembly 30*b* includes top cord 32*b* with a plurality of side stakes 34 extending between top cord 32*b* and a side sill. A plurality of metal sheets 36 may be securely attached with interior portions of top cord 32*b*, side stakes 34, and the side sill.

Railway car underframe 50 includes center sill 52 and a plurality of side sills. A pair of railway trucks 22 and 24 may be attached proximate opposite ends of center sill 52. In certain embodiments, center sill 52 may have a generally rectangular cross-section with a generally triangular-shaped dome or cover disposed thereon. Center sill 52 may have a wide variety of configurations and designs other than a rectangular cross section. The various embodiments described herein may be used with center sills that do not have domes or covers, and are not limited to the example of center sill 52. In certain embodiments, center sill 52 is located at the longitudinal centerline of hopper car 20 and defines a longitudinal axis of hopper car 20.

End wall assemblies 80*a* and 80*b* may have approximately the same overall configuration and dimensions. Therefore, only end wall assembly 80*a* will be described in detail. For some applications end wall assembly 80*a* may include sloped portion 82*a* and a generally vertical portion 84*a*. End wall assembly 80*a* may be formed from one or more metal sheets 86. Metal sheets 86 may have similar thickness and other characteristics associated with metal sheets 36.

The various embodiments described herein are also applicable to other types of railway cars having a wide variety of interior supporting structures. The various embodiments described herein are not limited to hopper cars having interior cross brace assemblies or hopper cars having longitudinal discharge openings.

Figure 2:
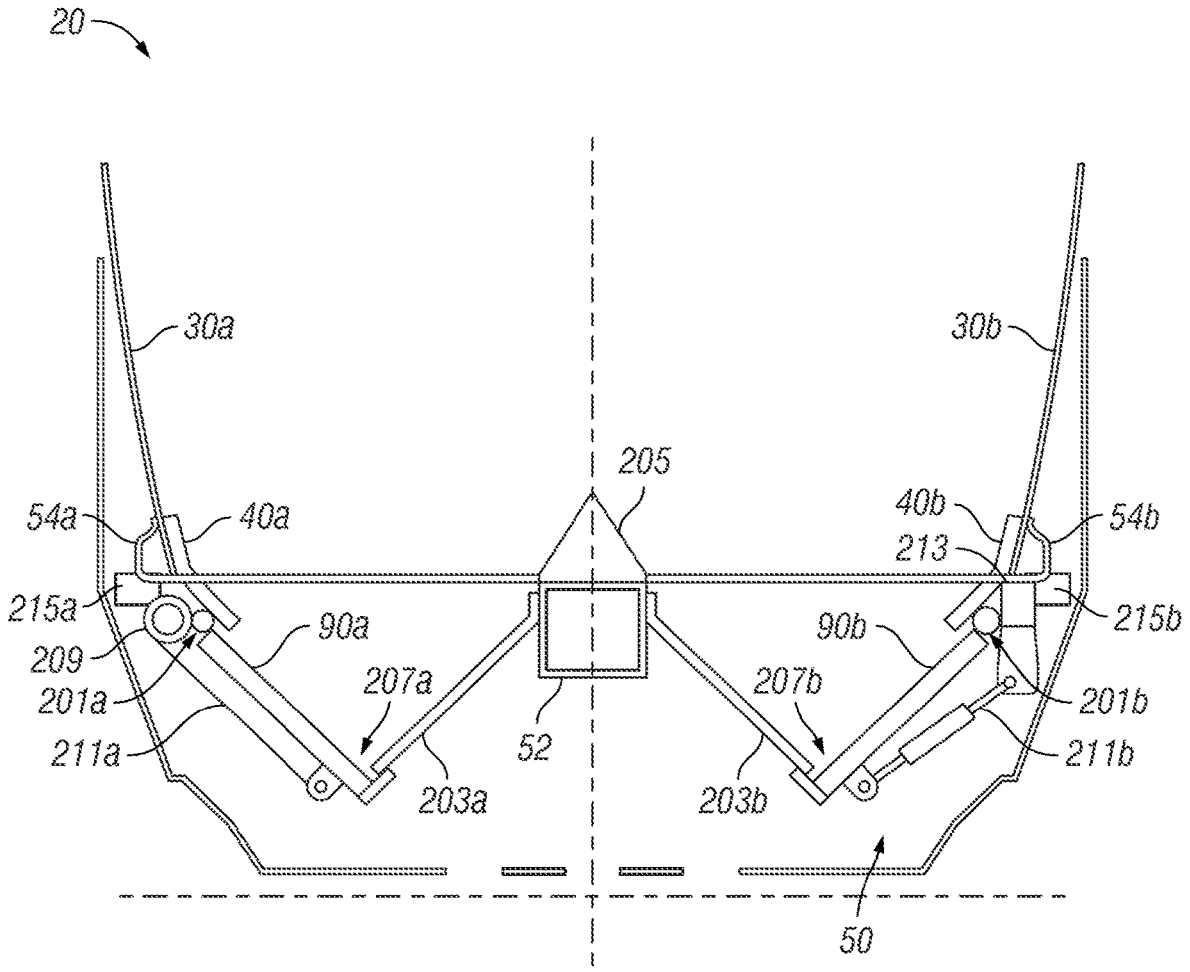
FIG. 2 is a schematic drawing in section with portions broken away taken along lines 3-3 of FIG. 1 showing portions of a discharge control system, in accordance with certain embodiments.

FIG. 2 is a schematic drawing in section with portions broken away taken along lines 3-3 of FIG. 1 showing portions of a discharge control system, in accordance with certain embodiments. In other words, FIG. 2 illustrates a cross-section of the example hopper car 20 of FIG. 1. As described above, hopper car 20 may include a pair of sidewall assemblies 30*a*, 30*b*, bottom slope sheet assemblies (which may be interchangeably referred to as fixed hopper sheets) 40*a* and 40*b* mounted on railway car underframe 50.

Railway car underframe 50 includes center sill 52 and side sills 54*a* and 54*b*. Center sill 52 is located at the longitudinal centerline of hopper car 52 and defines a longitudinal axis of hopper car 20. Side sills 54*a* and 54*b* extend generally parallel with center sill 52 and are spaced laterally from opposite sides of center sill 52. Side sills 54*a* and 54*b* may have any suitable shape and any suitable dimensions. In certain embodiments, side sills 54*a* and 54*b* act as stiffening members that run the entire length of hopper car 20. In certain embodiments, one or more components of a discharge control system (e.g., common linkage 209 (also referred to as torque tube 209) and common linkage 213 (also referred to as sliding beam 213)) may be mounted to side sills 54*a* and 54*b*. In certain embodiments, a plurality of cross bearers may be mounted on center sill 52. In such a scenario, side sills 54*a* and 54*b* may be attached to opposite ends of the cross bearers.

Fixed hopper sheets 40*a* and 40*b* may have approximately the same overall dimensions and configuration. Fixed hopper sheets 40*a* and 40*b* may be attached to respective side sills 54*a* and 54*b* in any suitable manner. Fixed hopper sheets 40*a* and 40*b* preferably extend inward at an angle from respective side sills 54*a* and 54*b*. In certain embodiments, fixed hopper sheets 40*a* and 40*b* may extend at an angle of approximately forty-five degrees (45°) relative to respective sidewall assemblies 30*a* and 30*b*, respectively. In certain embodiments, hinge point 201*a* and hinge point 201*b* may be mounted to fixed hopper sheet 40*a* and fixed hopper sheet 40*b*, respectively. In certain embodiments, one or more elements of a discharge control system/door closing mechanism may be mounted to fixed hopper sheets 40*a*, 40*b*.

In the example embodiment of FIG. 2, fixed hopper sheets 203*a*, 203*b* are mounted on opposite sides of center sill 52. In certain embodiments, fixed hopper sheets 203*a*, 203*b* may be mounted on hood 205. Portions of fixed hopper sheet 203*a* cooperate with adjacent portions of gate 90*a* to define a longitudinal discharge opening 207*a*. In a similar manner, portions of fixed hopper sheet 203*b* cooperate with adjacent portions of gate 90*b* to define a longitudinal discharge opening 207*b*. Longitudinal discharge openings 207*a* and 207*b* are preferably disposed along opposite sides of center sill 52. For some applications, hopper car 20 may be formed with more than one hopper and more than two longitudinal discharge openings. The various embodiments described herein are not limited to hopper cars with only two longitudinal discharge openings.

Gates 90*a* and 90*b* may be formed with overall dimensions and configurations similar to fixed hopper sheets 203*a* and 203*b*, respectively. Gates 90*a* and 90*b* are preferably hinged proximate the lower portion of fixed hopper sheets 40*a* and 40*b*, respectively. For example, gates 90*a* and 90*b* may be hinged at hinge points 201*a* and 201*b*, respectively. Hinge points 201*a* and 201*b* may have any suitable structure. For example, in certain embodiments one or more of hinge points 201*a* and 201*b* may have a structure comprising a fixed barrel and removable pin. As another example, in certain embodiments one or more of hinge points 201*a* and 201*b* may have a structure comprising a fixed pin affixed to one or more plates with holes that rotate around the fixed pin. The present disclosure contemplates that hinge points 201*a* and 201*b* may have any suitable structure. In certain embodiments, the type of hinge used may vary according to the discharge control system employed for opening and closing gates 90.

As described in detail below, various types of discharge control systems may be employed for opening and closing longitudinal door assemblies or gates 90*a* and 90*b*. In the example embodiment of FIG. 2, different discharge control systems are used for gates 90*a* and 90*b*, respectively. More particularly, FIG. 2 illustrates a first example embodiment of a discharge control system that uses a rotational methodology for opening gate 90*a*, and a second example embodiment of a discharge control system that uses a translational methodology for opening gate 90*b*. Although the example of FIG. 2 illustrates the use of different discharge control systems for each of gates 90*a* and 90*b*, the various embodiments described herein are not limited to the example illustrated in FIG. 2. Rather, the present disclosure contemplates that in certain embodiments, gates 90*a* and 90*b* may be opened and closed using the same type of discharge control system. In certain embodiments, the discharge control system associated with gate 90*a* and the discharge control system associated with gate 90*b* may be operated independently. This may advantageously allow gates 90*a* and 90*b* to be operated separately. For example, gate 90*a* may be opened while gate 90*b* may be closed.

As noted above, in the example embodiment of FIG. 2 gate 90*a* is operated using a discharge control system that uses a rotational methodology. In the example of FIG. 2, the discharge control system includes a common linkage (in this case, torque tube 209) and a secondary linkage (in this case, secondary linkage 211*a*).

In certain embodiments, torque tube 209 is mounted to the underside of side sill 54*a* as shown in FIG. 2. Torque tube 209 may be mounted to side sill 54*a* in any suitable manner. As one example, torque tube 209 may be mounted to side sill 54*a* using a combination torque tube and door hinge hanger support, as described in more detail in relation to FIGS. 5-7. As another example, torque tube 209 may be mounted to side sill 54*a* using a torque tube hangar support, as described in more detail below in relation to FIGS. 8-10. In certain embodiments, torque tube 209 is mounted to side sill 54*a* in a manner that allows torque tube 209 to rotate around a longitudinal axis of torque tube 209 in both a clockwise and counterclockwise manner. Rotation of torque tube 209 may be activated in any suitable manner. In certain embodiments, torque tube 209 may be activated by an actuator 215*a*. Examples of actuator 215*a* include, but are not limited to, a hydraulic actuator, a pneumatic actuator, or a manual actuator.

Torque tube 209 is coupled to a first end of secondary linkage 211*a*. Torque tube 209 may be coupled to secondary linkage 211*a* in any suitable manner. As one example, torque tube 209 may be coupled to secondary linkage 211*a* by welding the two together. A second end of secondary linkage 211*a* is coupled to gate 90*a*. Secondary linkage 211*a* may be coupled to gate 90*a* in any suitable manner. As one example, secondary linkage 211*a* may be coupled to gate 90*a* using a pinned connection. As another example, secondary linkage 211*a* may be coupled to gate 90*a* by welding.

Secondary linkage 211*a* may be any suitable linkage. In some cases, secondary linkage 211*a* may be a single element. In some cases, secondary linkage 211*a* may be formed of a number of individual elements joined together to form secondary linkage 211*a*. In certain embodiments secondary linkage 211*a* may be a fixed linkage (e.g., a rigid link). In such a scenario, secondary linkage 211*a* may, for example, comprise a bar with two pivoting rod ends. In certain embodiments, secondary linkage 211*a* may be a single fixed linkage affixed to torque tube 209 using a pinned connection. In some cases, secondary linkage 211*a* may be coupled to a spring. The spring may provide cushioning during the transition of gate 90*a* between a closed position (as shown in FIG. 2) and an open position, and vice versa. This may advantageously improve the performance of the operating assembly while at the same time reducing wear and tear to the system. Such an arrangement for secondary linkage 211*a* may advantageously allow gate 90*a* to be moved from a closed position (as shown in FIG. 2) to an open position, and from the open position to the closed position using a single discharge control system. In certain embodiments, secondary linkage 211 may be a cable. In such a scenario, the cable may be any suitable type of cable. For example, the cable may be a multi-stranded cable. Such an arrangement for secondary linkage 211*a* may advantageously be cost-effective.

In operation, activation of torque tube 209 (e.g., by hydraulic, pneumatic, manual, or other suitable means) may cause torque tube 209 to rotate in a clockwise direction relative to its longitudinal axis. Clockwise rotation of torque tube 209 causes movement of secondary linkage 211*a*. Movement of secondary linkage 211*a* in response to clockwise rotation of torque tube 209 pulls gate 90*a* away from fixed hopper sheet 203*a* from the closed position illustrated in FIG. 2 to an open position, thereby exposing longitudinal discharge opening 207*a*. Activation of torque tube 209 in the opposite direction (e.g., by hydraulic, pneumatic, manual, or other suitable means) causes torque tube 209 to rotate in a counterclockwise direction relative to its longitudinal axis.

Counterclockwise rotation of torque tube 209 causes movement of secondary linkage 211*a*. Movement of secondary linkage 211*a* in response to counterclockwise rotation of torque tube 209 pushes gate 90*a* toward fixed hopper sheet 203*a*, thereby moving gate 90*a* from the open position described above to the closed position illustrated in the example embodiment of FIG. 2.

As described above, in the example embodiment of FIG. 2 gate 90*b* is operated using a discharge control system that uses a translational beam methodology. In the example of FIG. 2, the discharge control system includes a common linkage (in this case, sliding beam 213) and a secondary linkage (in this case, linkage 211*b*).

In certain embodiments, sliding beam 213 is mounted to the underside of side sill 54*b*. Sliding beam 213 may be mounted to side sill 54*b* in any suitable manner. As one example, sliding beam 213 may be mounted to side sill 54*b* using one or more brackets. In certain embodiments, sliding beam 213 may be mounted to side sill 54*b* in a manner that allows sliding beam 213 to move parallel to its longitudinal axis and a longitudinal axis of hopper car 20 (e.g., as defined by center sill 52). In other words, sliding beam 213 may be mounted in a manner that allows sliding beam 213 to move into and out of the page as shown in FIG. 2. Movement of sliding beam 213 may be activated in any suitable manner. For example, movement of sliding beam 213 may be activated by an actuator, such as actuator 215*b*. Examples of an actuator for activating movement of sliding beam 213 include, but are not limited to, a hydraulic actuator, a pneumatic actuator, or manual actuator.

Sliding beam 213 is coupled to secondary linkage 211*b*. Sliding beam 213 may be coupled to secondary linkage 211*b* in any suitable manner. For example, in certain embodiments sliding beam 213 may be coupled to secondary linkage 211*a* via one or more brackets. Secondary linkage 211*b* is coupled to gate 90*b*. Secondary linkage 211*b* may be any suitable linkage. In some cases, secondary linkage 211*b* may be a single element. In some cases, secondary linkage 211*b* may be formed of a number of individual elements joined together to form secondary linkage 211*b*.

In certain embodiments secondary linkage 211*b* may be a fixed linkage (e.g., a rigid link). In such a scenario, secondary linkage 211*b* may, for example, comprise a bar with two pivoting rod ends. In certain embodiments, secondary linkage 211*b* may be a single fixed linkage affixed to sliding beam 213 using a pinned connection. In some cases, secondary linkage 211*b* may be coupled to a spring. The spring may provide cushioning during the transition of gate 90*b* between a closed position (as shown in FIG. 2) and an open position, and vice versa. This may advantageously improve the performance of the operating assembly while at the same time reducing wear and tear to the system. Such an arrangement for secondary linkage 211*b* may advantageously allow gate 90*b* to be moved from a closed position (as shown in FIG. 2) to an open position, and from the open position to the closed position using a single discharge control system.

In operation, activation of sliding beam 213 (e.g., by hydraulic, pneumatic, manual, or other suitable means) may cause sliding beam 213 to move parallel to a longitudinal axis of sliding beam 213 (and parallel to a longitudinal axis of hopper car 20). Movement of sliding beam 213 causes movement of secondary linkage 211*b*. For example, movement of sliding beam 213 parallel to a longitudinal axis of hopper car 20 may result in radial extension of secondary linkage 211*b* to move gate 90*b* from an open position to a closed position (as shown in FIG. 2). Movement of sliding beam 213 in the opposite direction relative to side sill 54*b* will result in pulling or moving gate 90*b* from the closed position (as shown in FIG. 2) to an open position, which may advantageously allow for rapid discharge of any lading contained within railway hopper car 20. In some cases, the secondary linkages may be pushed or pulled past center to provide a positive lock or over-center lock on gate 90*b*.

Figure 3A:
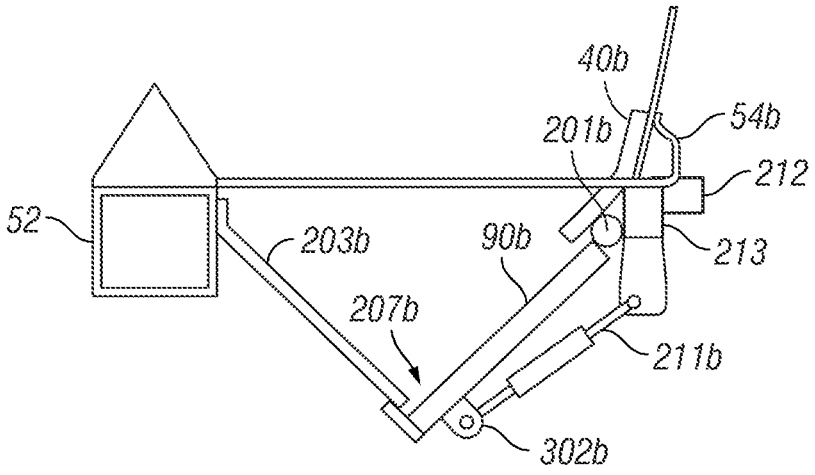
FIG. 3A-3C are schematic drawings illustrating an example embodiment in which the common linkage of the discharge control mechanism is a sliding beam, in accordance with certain embodiments.
Figure 3B:
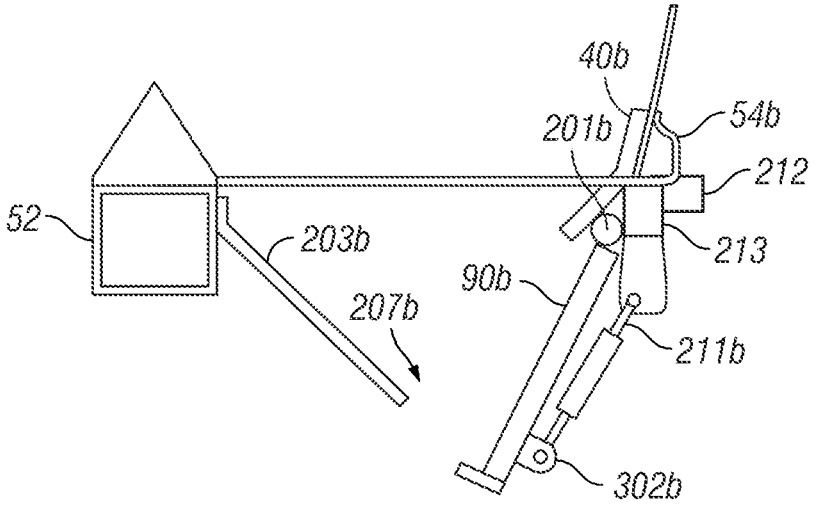
Figure 3C:
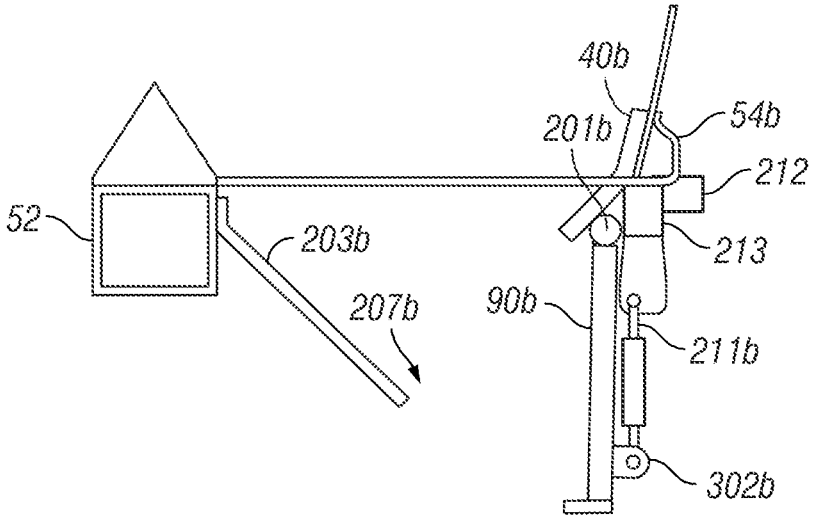

FIG. 3A-3C are schematic drawings illustrating an example embodiment in which the common linkage of the discharge control system is a sliding beam, in accordance with certain embodiments. In the examples of FIGS. 3A-3C, the discharge control system includes sliding beam 213 mounted to the underside of side sill 54*b*. Similar to FIG. 2 described above, in the examples of FIGS. 3A-3C sliding beam 213 is coupled to secondary linkage 211*b*. Secondary linkage 211*b* comprises an arm that connects the common linkage (i.e., sliding beam 213) to gate 90*b*. In certain embodiments, the length of secondary linkage 211*b* may be adjustable (for example, using a turnbuckle forming a part of secondary linkage 211*b*). Although secondary linkage 211*b* is illustrated as a single arm in the example of FIG. 3A, in certain embodiments additional secondary linkages can be added (for example, to accommodate heavier lading in railway hopper car 20).

In the example of FIG. 3A, secondary linkage 211*b* is coupled to gate 90*b* and sliding beam 213. More particularly, a first end 302*a* of secondary linkage 211*b* includes a ball joint rotatably engaged with a socket or boss coupled to sliding beam 213. In certain embodiments, secondary linkage 213 may rotate in three dimensions (such as longitudinal, lateral and vertical relative to side sill 54*b*). A second end 302*b* of secondary linkage 213 is rotatably engaged with gate 90*b*. In the example of FIG. 3A, gate 90*b* is hinged to fixed hopper sheet 40*b*. In certain embodiments, gate 90*b* may be hinged to any other suitable component of railway hopper car 20, such as side sill 54*b*.

In the example of FIG. 3A, gate 90*b* is in a closed position. In the closed position, gate 90*b* contacts fixed hopper sheet 203*b*, effectively preventing discharge of lading from longitudinal discharge opening 207*b*. In certain embodiments, secondary linkage 211*b*, while in the closed position, may be generally oriented perpendicular to sliding beam 213. As noted above with respect to FIG. 2, in the closed position (as shown in the example of FIG. 3A) secondary linkage 211*b* may be pushed or pulled past center to provide a positive lock or over-center lock on gate 90*b*.

In the example of FIG. 3B, gate 90*b* is shown in transition from the closed position of FIG. 3A to an open position (as shown in FIG. 3C described below). During transition from the closed position to the open position, gate 90*b* moves away from fixed hopper sheet 203*b*, exposing longitudinal opening 207*b*. FIG. 3B illustrates gate 90*b* in a partially open position such that secondary linkage 213 is controlling the movements of gate 90*b* throughout its range of motion.

In the example of FIG. 3C, gate 90*b* is shown in the open position, exposing longitudinal discharge opening 207*b* for the discharge of lading from railway hopper car 20. In the open position of FIG. 3C, secondary linkage 211*b* may rotate into a compound angle mainly oriented in the longitudinal direction parallel to the sliding beam 213 when gate 90*b* is in the open position.

As described above, sliding beam 213 may be coupled to an actuator (e.g., a hydraulic, pneumatic, manual, or other suitable actuator) capable of causing movement of sliding beam 213. The actuator may be located in any suitable area of railway hoper car 20. As one example, the actuator may be mounted to side sill 54*b*. In certain embodiments, sliding beam 213 may be mounted to side sill 54*b* such that when movement of sliding beam 213 is activated by the actuator, sliding beam 213 moves in a first or second direction generally parallel to side sill 54*b*. In operation, activation of sliding beam 213 (e.g., by hydraulic, pneumatic, manual, or other suitable means) may cause sliding beam 213 to move parallel to a longitudinal axis of side sill 54*b* (and parallel to a longitudinal axis of hopper car defined by center sill 52). Movement of sliding beam 213 causes movement of secondary linkage 211*b*. For example, movement of sliding beam 213 in a first direction parallel to a longitudinal axis of hopper car 20 may result in radial extension of secondary linkage 211*b* to move gate 90*b* from an open position (as shown in FIG. 3C) to a closed position (as shown in FIG. 3A). Movement of sliding beam 213 in a second direction opposite the first direction will result in pulling or moving gate 90*b* from the closed position (as shown in FIG. 3A) to an open position (as shown in FIG. 3C).

More particularly, longitudinal movement of sliding beam 213 in the first direction will result in radial extension of secondary linkage 213 to move gate 90*b* from the open position (as shown in FIG. 3C) to the closed position (as shown in FIG. 3A). Movement of sliding beam 213 in the second, opposite direction relative to side sill 54*b* will result in pulling or moving gate 90*b* from the closed position (as shown in FIG. 3A) to the open position (as shown in FIG. 3C), which advantageously allows discharge of lading contained within railway hopper car 20.

Figure 4:
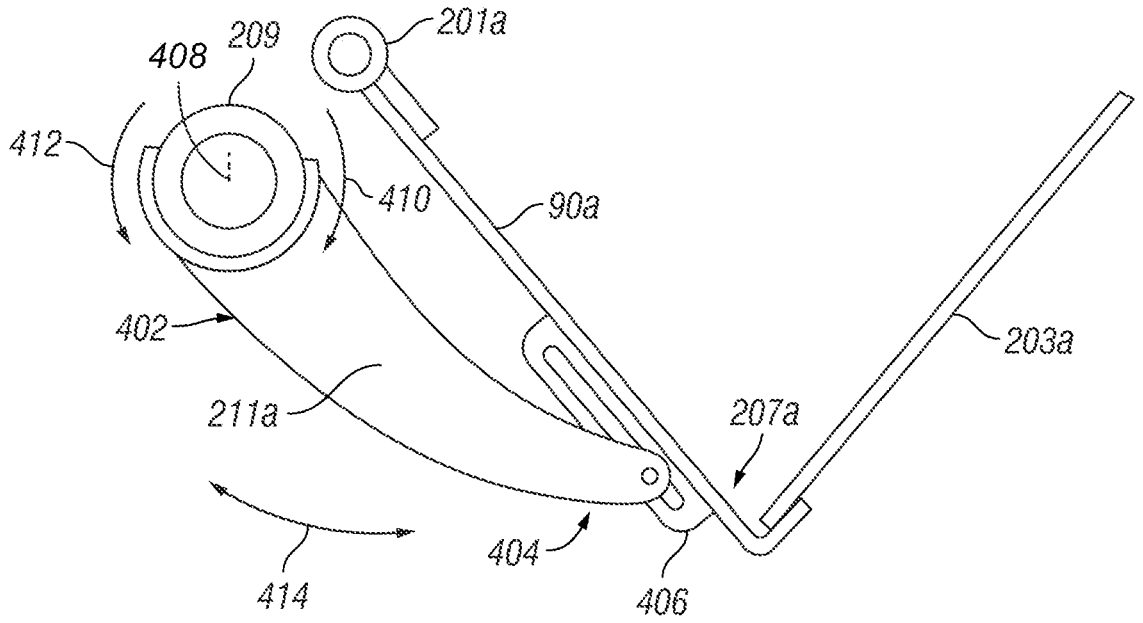
FIG. 4 is a schematic drawing illustrating an example embodiment in which the common linkage of the discharge control system is a torque tube, in accordance with certain embodiments.

FIG. 4 is a schematic drawing illustrating a first view of an example embodiment in which the common linkage of the discharge control system is a torque tube, in accordance with certain embodiments. As described above, in certain embodiments a discharge control system may employ a rotational methodology using torque tube 209 as the common linkage. FIG. 4 illustrates torque tube 209 (which may be mounted to the underside of side sill 54*b* as described above in relation to FIG. 2). Torque tube 209 is coupled to a first end 402 of secondary linkage 211*a*. In certain embodiments, torque tube 209 is coupled to first end 402 of secondary linkage 211*a* by welding. A second end 404 of secondary linkage 211*a* is coupled to gate 90*a*. In the example embodiment of FIG. 4, second end 404 of secondary linkage 211*a* is coupled to gate 90*a* via pinned connection 406. Gate 90*a* is coupled to hinge point 201*a*. In the example of FIG. 4, gate 90*a* is shown in a closed position. In the closed position, gate 90*a* contacts fixed hopper sheet 203*a*, effectively preventing discharge of lading from longitudinal discharge opening 207*a*.

As described above, in certain embodiments torque tube 209 may be mounted to the underside of side sill 54*a* in a manner that allows torque tube 209 to rotate around a longitudinal axis of torque tube 209 in both a clockwise and counterclockwise manner relative to its longitudinal axis 408 (as illustrated by arrows 410 and 412, respectively). Rotation of torque tube 209 may be activated in any suitable manner. In certain embodiments, torque tube 209 may be activated by an actuator, such as actuator 215*a* described above in relation to FIG. 2. Examples of actuators include, but are not limited to, a hydraulic actuator, a pneumatic actuator, or a manual actuator.

In operation, activation of torque tube 209 (e.g., by hydraulic, pneumatic, manual, or other suitable means) may cause torque tube 209 to rotate in clockwise direction 410 relative to its longitudinal axis 408. Clockwise rotation 410 of torque tube 209 causes movement of secondary linkage 211*a*. Movement of secondary linkage 211*a* in response to clockwise rotation 410 of torque tube 209 pulls gate 90*a* away from fixed hopper sheet 203*a* from the closed position illustrated in FIG. 4 to an open position (not expressly shown), thereby exposing longitudinal discharge opening 207*a*. Activation of torque tube 209 in the opposite direction (i.e., counter clockwise rotation 412) (e.g., by hydraulic, pneumatic, manual, or other suitable means) causes torque tube 209 to rotate in a counterclockwise direction relative to its longitudinal axis 408. Counterclockwise rotation 412 of torque tube 209 causes movement of secondary linkage 211*a*. Movement of secondary linkage 211*a* in response to counterclockwise rotation 412 of torque tube 209 pushes gate 90*a* toward fixed hopper sheet 203*a*, thereby moving gate 90*a* from the open position described above to the closed position illustrated in the example embodiment of FIG. 4. The above-described movement of secondary linkage 211*a* and gate 90*a* is depicted in FIG. 4 by arrow 414.

In certain embodiments, the direction of rotation of torque tube 209 may be reversed depending on which side of hopper car 20 torque tube 209 is placed. For example, in certain embodiments counterclockwise rotation of torque tube 209 may pull a gate 90 from a closed position to an open position and clockwise rotation may push a gate 90 to the closed position.

Figure 5:
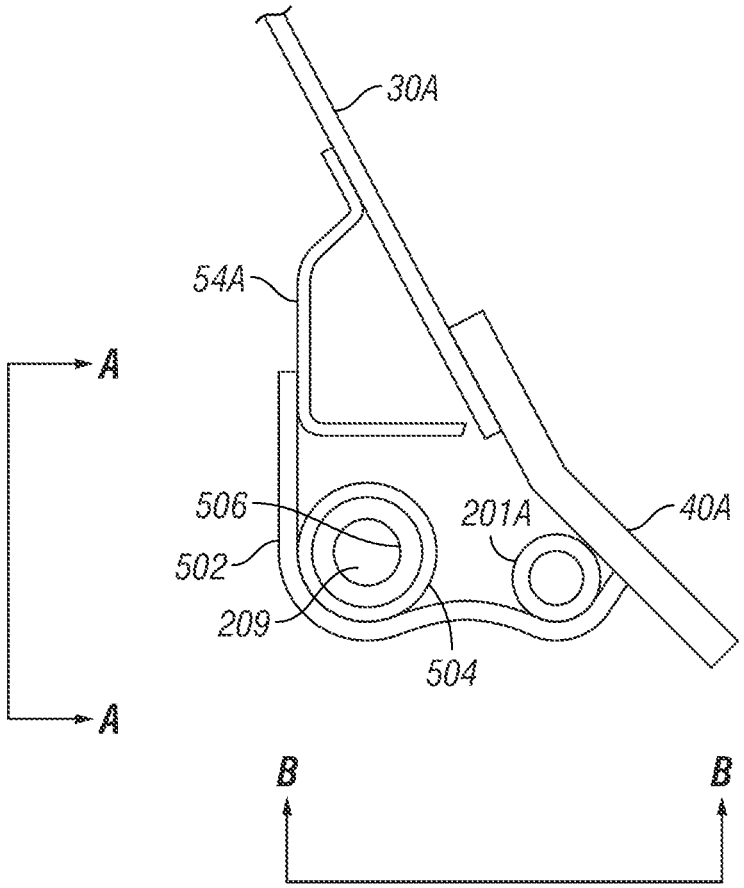
FIG. 5 is a schematic drawing illustrating a first view of an example embodiment of a combination torque tube and door hinge hanger support, in accordance with certain embodiments.

FIG. 5 is a schematic drawing illustrating a first view of an example embodiment of a combination torque tube and door hinge hanger support 502, in accordance with certain embodiments. As described above, in certain embodiments torque tube 209 may be mounted to the underside of side sill 54*a* and operate to move gate 90*a* from an open to a closed position, and vice versa. To facilitate proper operation of the discharge control system and torque tube 209, torque tube 209 should be mounted in a manner that permits the rotation of torque tube 209 as described above in relation to FIGS. 2 and 4. Advantageously, the example embodiment of FIG. 5 provides one such mechanism for mounting torque tube 209 to side sill 54*a*.

In the example of FIG. 5, torque tube 209 is mounted to the underside of side sill 54*a* using a combination hanger and door support. Combination torque tube and door hinge hanger support 502 is coupled to side sill 54*a* and bottom slope sheet 40*a*. The combination torque tube and door hinge hanger support 502 of FIG. 5 houses both torque tube 209 and door hinge 201*a*. Hanger support 502 may be made from any suitable materials, and may be affixed to side sill 54*a* and bottom slope sheet 40*a* in any suitable manner.

As shown in FIG. 5, within combination torque tube and door hinge hanger support 502, torque tube 209 is positioned within torque tube support 504. Bushing 506 is inserted between torque tube 209 and torque tube support 504. Bushing 506 may be made of any suitable material (e.g., a polymer or brass). Bushing 506 may advantageously facilitate rotation of torque tube 209 within torque tube support 504 and combination hanger and door support 502.

Figure 6:
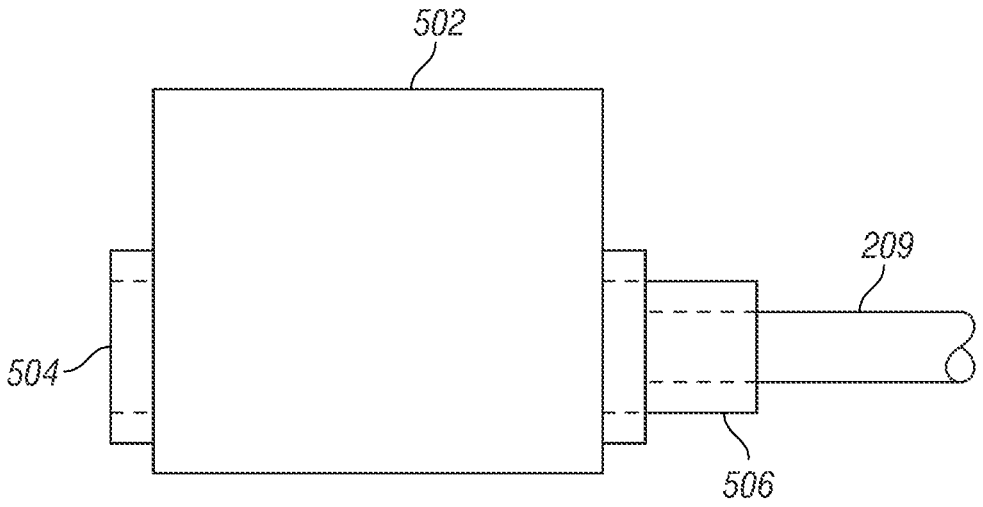
FIG. 6 is a schematic drawing illustrating a second view of the example embodiment of the combination torque tube and door hinge hanger support of FIG. 5 taken along lines A-A of FIG. 5, in accordance with certain embodiments.

FIG. 6 is a schematic drawing illustrating a second view of the example embodiment of the combination torque tube and door hinge hanger support of FIG. 5 taken along lines A-A of FIG. 5, in accordance with certain embodiments. As shown in FIG. 6, torque tube 209 is positioned within torque tube support 504. Bushing 506 is inserted between torque tube 209 and torque tube support 504 to facilitate rotation of torque tube 209 within torque tube support 504. Torque tube support 504, bushing 506, and torque tube 209 are positioned within hangar support 502 as illustrated in FIG. 6. Although FIG. 6 illustrates a portion of bushing 506 extending from torque tube support 504, this is for purposes of clarity. In operation, bushing 506 and torque tube support 504 will generally be flush.

Figure 7:
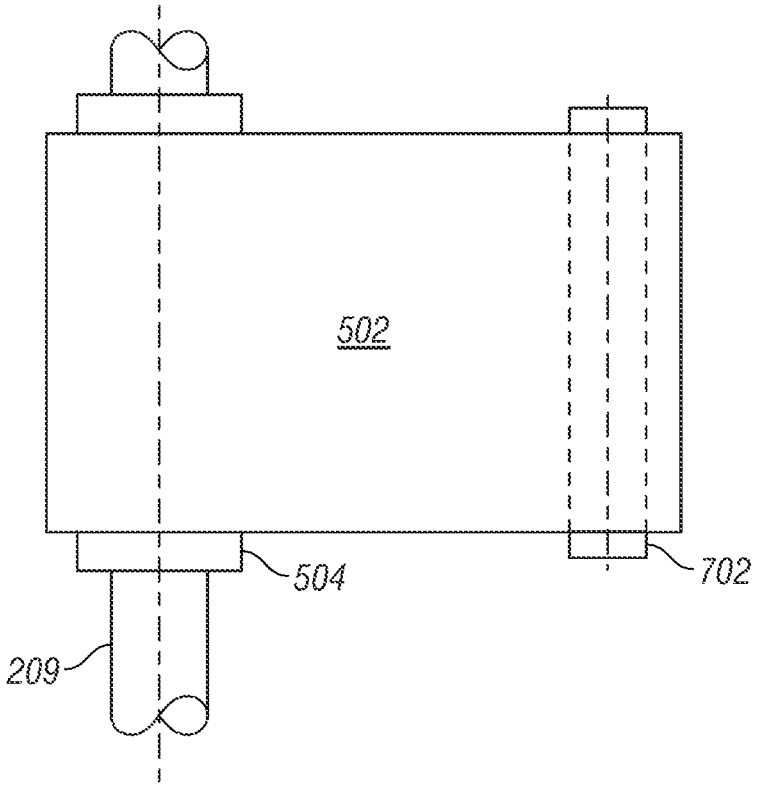
FIG. 7 is a schematic drawing illustrating a third view of the example embodiment of the combination torque tube and door hinge hanger support of FIG. 5 taken along lines B-B of FIG. 5, in accordance with certain embodiments.

FIG. 7 is a schematic drawing illustrating a third view of the example embodiment of the combination torque tube and door hinge hanger support of FIG. 5 taken along lines B-B of FIG. 5, in accordance with certain embodiments. As shown in FIG. 7, combination torque tube and hanger support 502 includes hinge tube door support 702 and torque tube 209 positioned within torque tube support 504.

Figure 8:
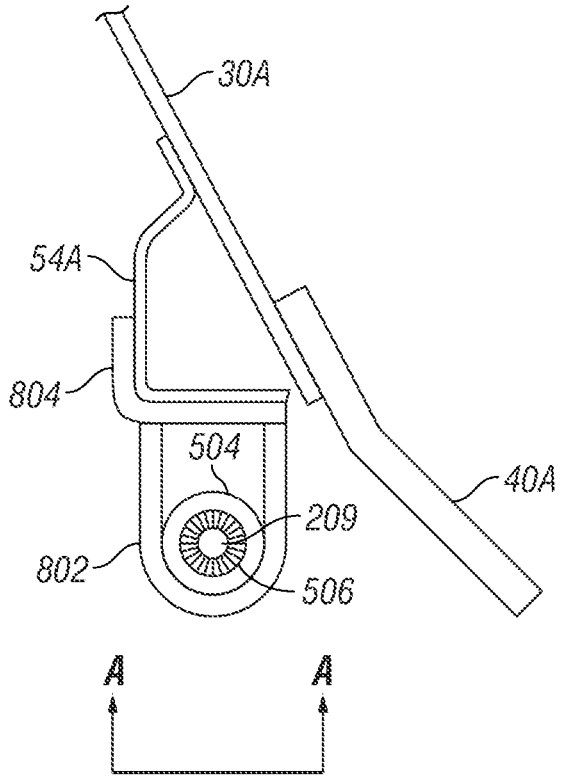
FIG. 8 is a schematic drawing illustrating a first view of an example embodiment of a torque-tube hangar support, in accordance with certain embodiments.

FIG. 8 is a schematic drawing illustrating a first view of an example embodiment of a torque-tube hangar support 802, in accordance with certain embodiments. As described above, in certain embodiments torque tube 209 may be mounted to the underside of side sill 54*a* and operate to move gate 90*a* from an open to a closed position, and vice versa. To facilitate proper operation of the discharge control system and torque tube 209, torque tube 209 should be mounted in a manner that permits the rotation of torque tube 209 as described above in relation to FIGS. 2 and 4. Advantageously, the example embodiment of FIG. 8 provides one such mechanism for mounting torque tube 209 to side sill 54*a*.

In the example of FIG. 8, torque tube 209 is mounted to the underside of side sill 54*a* using hanger support 802. Hanger support 802 may be formed from any suitable material(s). Hanger support 802 is coupled to hanger base plate 804. Hanger support 802 may be coupled to hanger base plate 804 in any suitable manner. As one example, hanger support 802 may be coupled to hanger base plate 804 by welding. As another example, hanger support 802 may be removably coupled to hanger base plate 804 (e.g., using one or more suitable fasteners). Hanger base plate 804 is mounted to side sill 54*a*. Hanger base plate 804 may be mounted to side sill 54*a* in any suitable manner.

Hanger support 802 houses torque tube 209. As shown in FIG. 8, within hanger support 802 torque tube 209 is positioned within torque tube support 504. Bushing 506 is inserted between torque tube 209 and torque tube support 504. Bushing 506 may be made of any suitable material. Bushing 506 may advantageously facilitate rotation of torque tube 209 within torque tube support 504 and hanger support 802.

Figure 9:
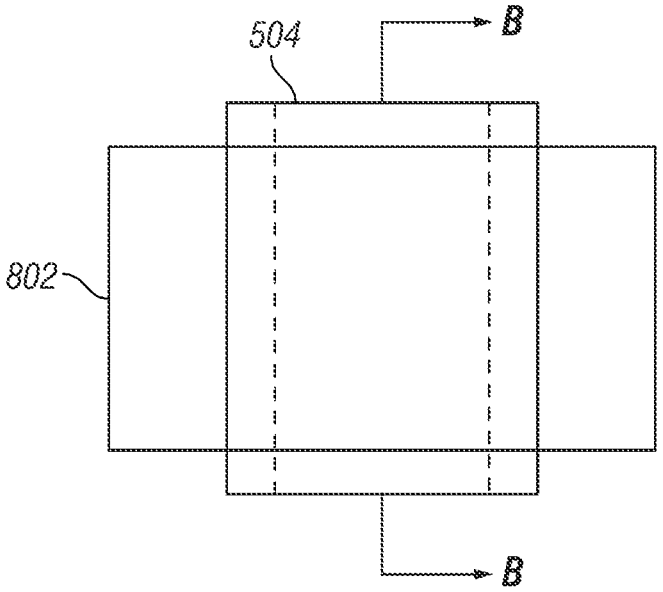
FIG. 9 is a schematic drawing illustrating a second view of the example embodiment of the torque-tube hangar support of FIG. 8 taken along lines A-A of FIG. 8, in accordance with certain embodiments.

FIG. 9 is a schematic drawing illustrating a second view of the example embodiment of the torque-tube hangar support of FIG. 8 taken along lines A-A of FIG. 8, in accordance with certain embodiments. As described above, torque tube 209 may be positioned within torque tube support 504. As shown in FIG. 9, torque tube support 504 is positioned within hangar support 802 as illustrated in FIG. 9. As described above, bushing may be inserted between torque tube 209 and torque tube support 504 to facilitate rotation of torque tube 209 within torque tube support 504.

Figure 10:
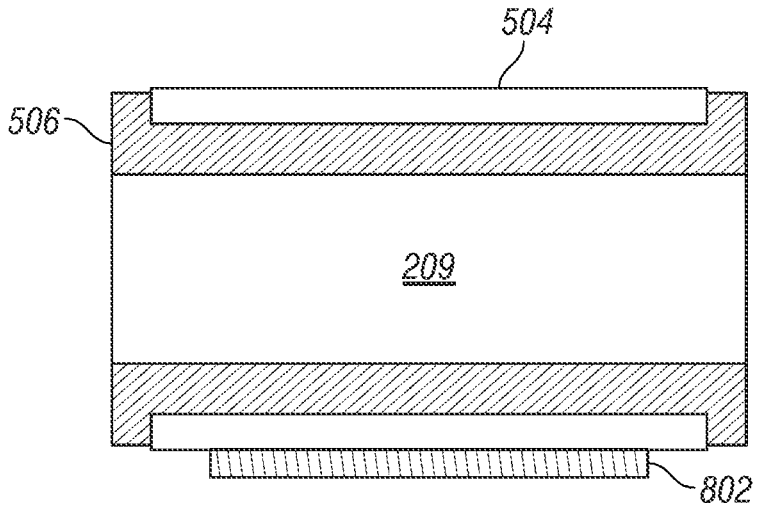
FIG. 10 is a schematic drawing illustrating a third view of the example embodiment of the torque-tube hangar support of FIG. 8 taken along lines B-B of FIG. 9, in accordance with certain embodiments.

FIG. 10 is a schematic drawing illustrating a third view of the example embodiment of the torque-tube hangar support of FIG. 8 taken along lines B-B of FIG. 9, in accordance with certain embodiments. More particularly, FIG. 10 illustrates a section view of torque tube 209 positioned in torque tube support 504 within hanger support 802. In certain embodiments, torque tube support 504 may be a pipe. Torque tube 209 is located within torque tube support 504. In the example of FIG. 10, bushing 506 (e.g., a polymer or brass bushing) is inserted between torque tube 209 and torque tube support 504. Torque tube support 504 (together with torque tube 209 and bushing 506 is mounted to the underside of side sill 54*a* (not expressly shown) using hangar support 802 as described above in relation to FIG. 8.

Figure 11:
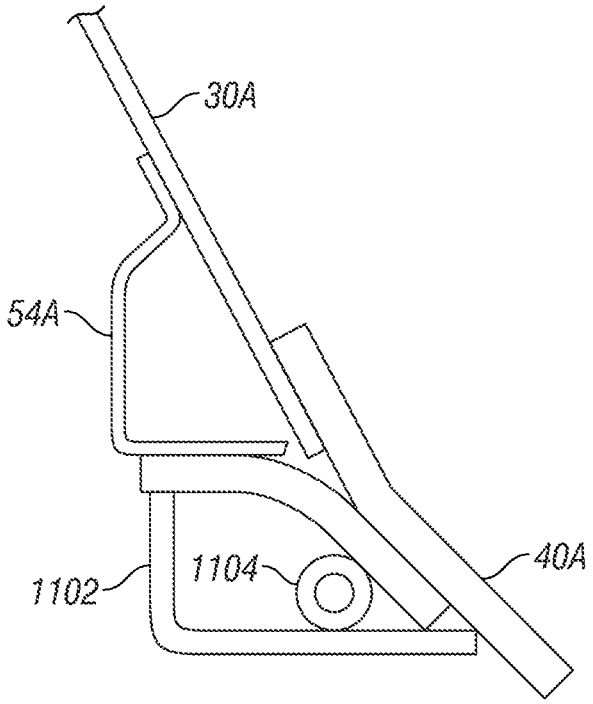
FIG. 11 is a schematic drawing illustrating an example embodiment of a door-hinge, in accordance with certain embodiments.

FIG. 11 is a schematic drawing illustrating an example embodiment of a door hinge, in accordance with certain embodiments. More particularly, FIG. 11 illustrates hinge support plate 1102 coupled to the underside of side sill 54*a* and bottom slope sheet 40*a*. Hinge support plate 1102 may be formed from any suitable material(s). In certain embodiments, hinge support plate may be formed as a single piece or multiple pieces. Door hinge tube 1104 is positioned within hinge support plate 1102. In certain embodiments, door hinge tube 1104 may be a pipe.

As described above in relation to FIG. 2, gate 90*a* is preferably hinged proximate the lower portion of fixed hopper sheet 40*a* (e.g., at hinge point 201*a* described above). Advantageously, the hinge support plate 1102 may provide support for hinge point 201*a* described above and facilitate the movement of gate 90*a* from a closed position to an open position and vice versa, as described above in relation to FIGS. 2-4.

Advantageously, the door hinge described above in relation to FIG. 11 may be used with either the rotational methodology (described above in relation to FIGS. 2 and 4) or the translational methodology (described above in relation to FIGS. 2 and 3A-C).

Figure 12:
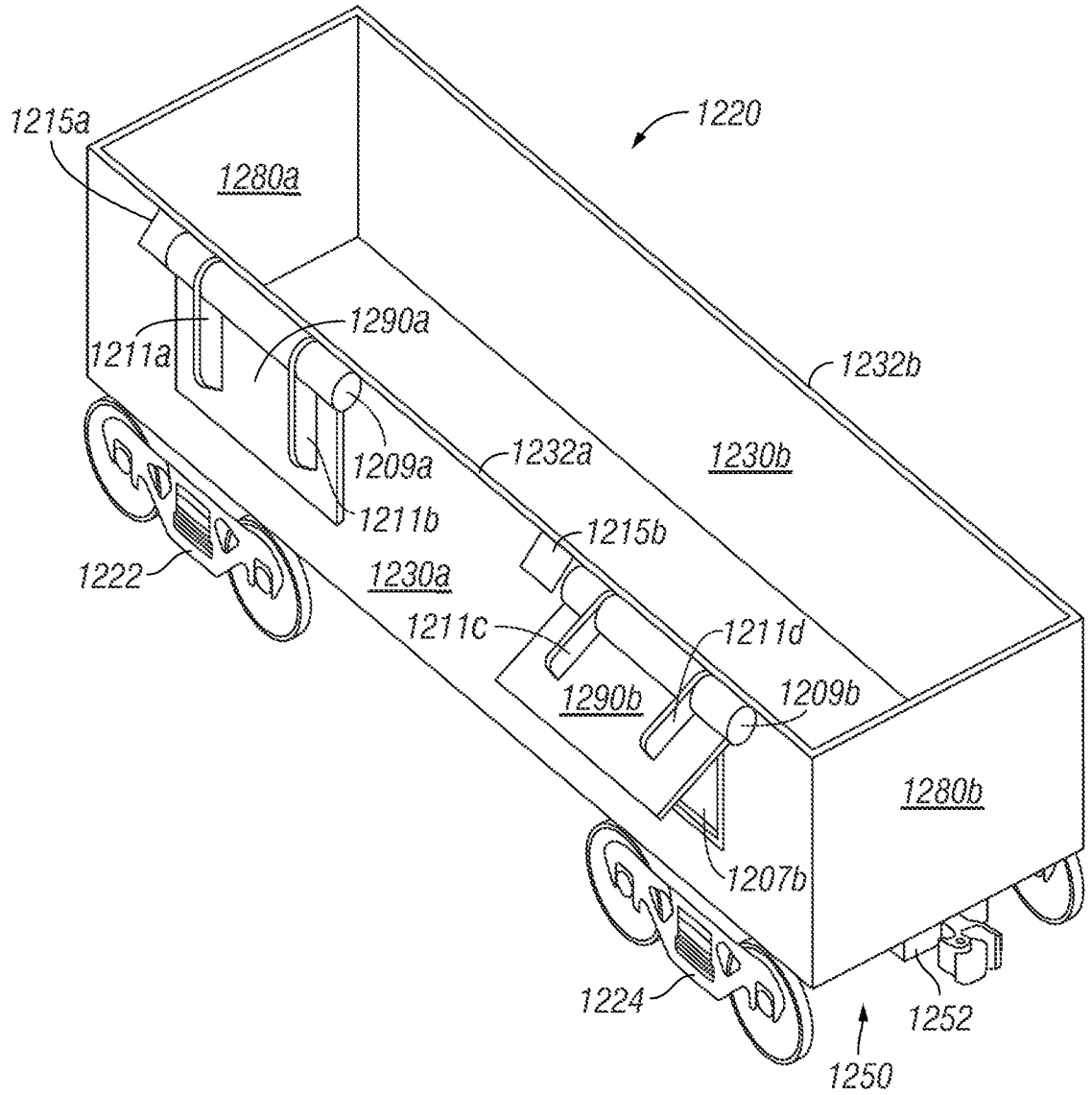
FIG. 12 is a schematic drawing illustrating an embodiment of a discharge control system for a gondola car, in accordance with certain embodiments.

FIG. 12 is a schematic drawing illustrating an embodiment of a discharge control system for a gondola railway car 1220, in accordance with certain embodiments. As described above, the various embodiments described herein are not limited to hopper cars and can be advantageously applied to any suitable type of railway car, such as gondola car 1220. Gondola car 1220 may be used to carry any suitable type of lading. Gondola car 1220 may have any suitable dimensions. Gondola car 1220 may be generally described as an open gondola car with a pair of discharge openings or outlets. Respective door assemblies or gates may be opened and closed to control discharge of lading from the discharge openings or outlets of gondola car 1220.

In the example embodiment of FIG. 12, gondola car 1220 includes a pair of sidewall assemblies 1230*a* and 1230*b*. As shown in FIG. 12, sidewall assembly 1230*a* includes top chord 1232*a* and sidewall assembly 1230*b* includes top cord 1232*b*. Gondola car 1220 also includes a pair of end wall assemblies 1280*a* and 1280*b*. End wall assemblies 1280*a* and 1280*b* may have approximately the same overall configuration and dimensions. In the example of FIG. 12, end wall assemblies 1280*a* and 1280*b* are generally vertical. In certain embodiments, end wall assemblies 1280*a* and 1280*b* may be formed from one or more metal sheets. The metal sheets may have similar thickness and other characteristics.

Railway car underframe 1250 includes center sill 1252. A pair of railway trucks 1222 and 1224 are attached proximate opposite ends of center sill 1252. In certain embodiments, center sill 1252 may have a generally rectangular cross-section with a generally triangular-shaped dome or cover disposed thereon. Center sill 1252 may have a wide variety of configurations and designs other than a rectangular cross section. The various embodiments described herein may be used with center sills that do not have domes or covers, and are not limited to the example of center sill 1252. In certain embodiments, center sill 1252 is located at the longitudinal centerline of gondola car 1220 and defines a longitudinal axis of gondola car 1220.

In certain embodiments, railway car underframe 1250 may also include a plurality of side sills that extend generally parallel with center sill 1252 and are spaced laterally from opposite sides of center sill 1252. In such a scenario, the side sills may have any suitable shape and any suitable dimensions. In certain embodiments, the side sills may act as stiffening members that run the entire length of gondola car 1220. In certain embodiments, a plurality of cross bearers may be mounted on center sill 1252. In such a scenario, the side sills may be attached to opposite ends of the cross bearers.

In the example embodiment of FIG. 12, gondola car 1220 includes a pair of longitudinal discharge openings 1207*a* (not expressly shown) and 1207*b* in sidewall assembly 1230*a*. Each discharge opening 1207 has an associated door assembly including a gate 1290. For example, discharge opening 1207*a* is associated with a door assembly including gate 1290*a* and discharge opening 1207*b* is associated with a door assembly including gate 1290*b*.

Gates 1290*a* and 1290*b* may be formed with overall dimensions and configurations similar to discharge openings 1207*a* and 1207*b*, respectively. Gates 1290*a* and 1290*b* are preferably hinged to sidewall assembly 1230*a* proximate an upper portion of discharge openings 1207*a* and 1207*b*, respectively. Gates 1290*a* and 1290*b* may be hinged in any suitable manner (for example, using hinge points analogous to those described above in relation to FIG. 2).

As described in detail below, various types of discharge control systems may be employed for opening and closing longitudinal door assemblies or gates 1290*a* and 1290*b*. In the example embodiment of FIG. 12, a discharge control system that uses a rotational methodology (similar to that described above in relation to FIGS. 2 and 4) is used for gates 1290*a* and 1290*b*, respectively. Although the example of FIG. 12 illustrates the use of a discharge control system that uses a rotational methodology, other discharge control systems may be used for each of gates 1290*a* and 1290*b*. For example, in certain embodiments a translational methodology (similar to that described above in relation to FIGS. 2 and 3A-C) may be used for one or more of gates 1290*a* and 1290*b*. In certain embodiments, the discharge control system associated with gate 1290*a* and the discharge control system associated with gate 1290*b* may be operated independently. This may advantageously allow gates 1290*a* and 1290*b* to be operated separately. For example, gate 1290*a* may be closed while gate 1290*b* is open (as shown in the example of FIG. 12).

As described above, in the example embodiment of FIG. 12 gates 1290*a* and 1290*b* are operated using a discharge control system that uses a rotational methodology. Each discharge control system includes a common linkage 1209 (a torque tube in the example of FIG. 12) and a secondary linkage 1211. More particularly, the discharge control system associated with gate 1290*a* includes torque tube 1209*a* as the common linkage and secondary linkages 1211*a* and 1211*b*. The discharge control system associated with gate 1290*b* includes torque tube 1209*b* and secondary linkages 1211*c* and 1211*d*. Although the example embodiment of FIG. 12 illustrates the use of torque tubes 1209*a* and 1209*b* with gates 1290*a* and 1290*b*, respectively, the present disclosure is not limited to this example. Rather, the present disclosure contemplates that other arrangements may be used. For example, in certain embodiments a single torque tube 1209 may be used to operate both gates 1290*a* and 1290*b*. Additionally, although the example embodiment of FIG. 12 illustrates the use of two secondary linkages for each discharge control system associated with gates 1290*a* and 1290*b*, respectively, the present disclosure is not limited to this example. Rather, the present disclosure contemplates that any suitable number of secondary linkages 1211 may be used (e.g., a single secondary linkage 1211 for each of gates 1290*a* and 1290*b*).

In certain embodiments, torque tubes 1209*a* and 1209*b* are mounted to railway car 1220 proximate to top chord 1232*a*. In certain embodiments, one or more of torque tubes 1209*a*, 1209*b* may be mounted to sidewall assembly 1230*a*. In certain embodiments, one or more of torque tubes 1209*a*, 1209*b* may be mounted to top chord 1232*a*. Torque tubes 1209*a*, 1209*b* may be mounted to sidewall assembly 1230*a* or top chord 1232*a* in any suitable manner. For example, torque tubes 1209*a*, 1209*b* may be mounted to sidewall assembly 1230*a* or top chord 1232*a* using a hanger support (similar to the hangar supports described above in relation to FIGS. 5-10). In certain embodiments, torque tubes 1209*a*, 1209*b* are mounted to sidewall assembly 1230*a* or top chord 1232*a* in a manner that allows torque tubes 1209*a*, 1209*b* to rotate around longitudinal axes of torque tubes 1209*a*, 1209*b* in both a clockwise and counterclockwise manner. Rotation of torque tubes 1209*a*, 1209*b* may be activated in any suitable manner. In certain embodiments, torque tube 1209*a* may be activated by actuator 1215*a*, and torque tube 1209*b* may be activated by actuator 1215*b*. Examples of actuators 1215*a*, 1215*b* include, but are not limited to, a hydraulic actuator, a pneumatic actuator, or a manual actuator. Although the example embodiment of FIG. 12 illustrates the use of actuators 1215*a*, 1215*b* with torque tubes 1209*a*, 1209*b*, respectively, the present disclosure is not limited to such an example. Rather, the present disclosure contemplates that any suitable number of actuators 1215 may be used. For example, a single actuator 1215 may be used in cases where the discharge control systems for gates 1290*a* and 1290*b* uses a single torque tube 1209.

In the example embodiments of FIG. 12, the discharge control systems for gates 1290*a* and 1290*b* have approximately the same overall configuration and dimensions. Therefore, only the discharge control system associated with gate 1290*b* will be described in detail. Torque tube 1209*b* is coupled to a first end of secondary linkage 1211*c* and a first end of secondary linkage 1211*d*. Torque tube 1209*b* may be coupled to secondary linkages 1211*c*, 1211*d* in any suitable manner. As one example, torque tube 1209*b* may be coupled to secondary linkages 1211*c*, 1211*d* by welding. A second end of each of secondary linkages 1211*c* and 1211*d* is coupled to gate 1290*b*. Secondary linkages 1211*c* and 1211*d* may be coupled to gate 1290*b* in any suitable manner. As one example, secondary linkages 1211*c* and 1211*d* may be coupled to gate 1290*b* using a pinned connection (as described above in relation to FIG. 4).

Secondary linkages 1211*c* and 1211*d* may be any suitable linkage. In some cases, each of secondary linkages 1211*c* and 1211*d* may be a single element. In some cases, each of secondary linkages 1211*c* and 1211*d* may be formed of a number of individual elements joined together to form the secondary linkage. In certain embodiments, one or more of secondary linkages 1211*c*, 1211*d* may be a fixed linkage (e.g., a rigid link). In such a scenario, secondary linkages 1211*c*, 1211*d* may, for example, comprise a bar with two pivoting rod ends. In certain embodiments, secondary linkages 1211*c*, 1211*d* may be a single fixed linkage affixed to torque tube 1209*b* using a pinned connection. In some cases, secondary linkages 1211*c*, 1211*d* may be coupled to one or more springs. The spring may provide cushioning during the transition of gate 1290*b* between a closed position (as shown for gate 1290*a* in the example embodiment of FIG. 12) and an open position (as shown for gate 1290*b* in the example embodiment of FIG. 12), and vice versa. This may advantageously improve the performance of the operating assembly while at the same time reducing wear and tear to the system. Such an arrangement for secondary linkages 1211*c*, 1211*d* may advantageously allow gate 1290*b* to be moved from a closed position to an open position, and from the open position to the closed position using a single discharge control system. In certain embodiments, one or more of secondary linkages 1211*c*, 1211*d* may be cables. In such a scenario, the cable may be any suitable type of cable. For example, the cable may be a multi-stranded cable. As described above in relation to FIG. 2, such an arrangement for secondary linkages 1211*c*, 1211*d* may advantageously be cost-effective.

Similar to the example embodiments of FIG. 2 and FIG. 4 described above, in operation, activation of torque tube 1209*b* (e.g., by hydraulic, pneumatic, manual, or other suitable means) may cause torque tube 1209*b* to rotate in a clockwise direction relative to its longitudinal axis. Clockwise rotation of torque tube 1209*b* causes movement of secondary linkages 1211*c* and 1211*d*. Movement of secondary linkages 1211*c* and 1211*d* in response to clockwise rotation of torque tube 1209*b* pulls gate 1290*b* away from sidewall assembly 1230*a* from a closed position (as illustrated in FIG. 12 for gate 1290*a*) to an open position, thereby exposing longitudinal discharge opening 1207*b*. Activation of torque tube 1209*b* in the opposite direction (e.g., by hydraulic, pneumatic, manual, or other suitable means) causes torque tube 1209*b* to rotate in a counterclockwise direction relative to its longitudinal axis. Counterclockwise rotation of torque tube 1209*b* causes movement of secondary linkages 1211*c*, 1211*d*. Movement of secondary linkages 1211*c* and 1211*d* in response to counterclockwise rotation of torque tube 1209*b* pushes gate 1290*b* toward sidewall assembly 1230*a*, thereby moving gate 1290*b* from an open position to a closed position.

In certain embodiments, the direction of rotation of torque tube 209 may be reversed depending on which side of gondola car 1220 torque tube 1209*b* is placed. For example, in certain embodiments discharge openings 1207*a*, 1207*b* may be located in sidewall assembly 1230*b*. In such a scenario, counterclockwise rotation of torque tube 1209*b* may pull gate 1290*b* from a closed position to an open position and clockwise rotation may push gate 1290*b* to the closed position.

Figure 13:
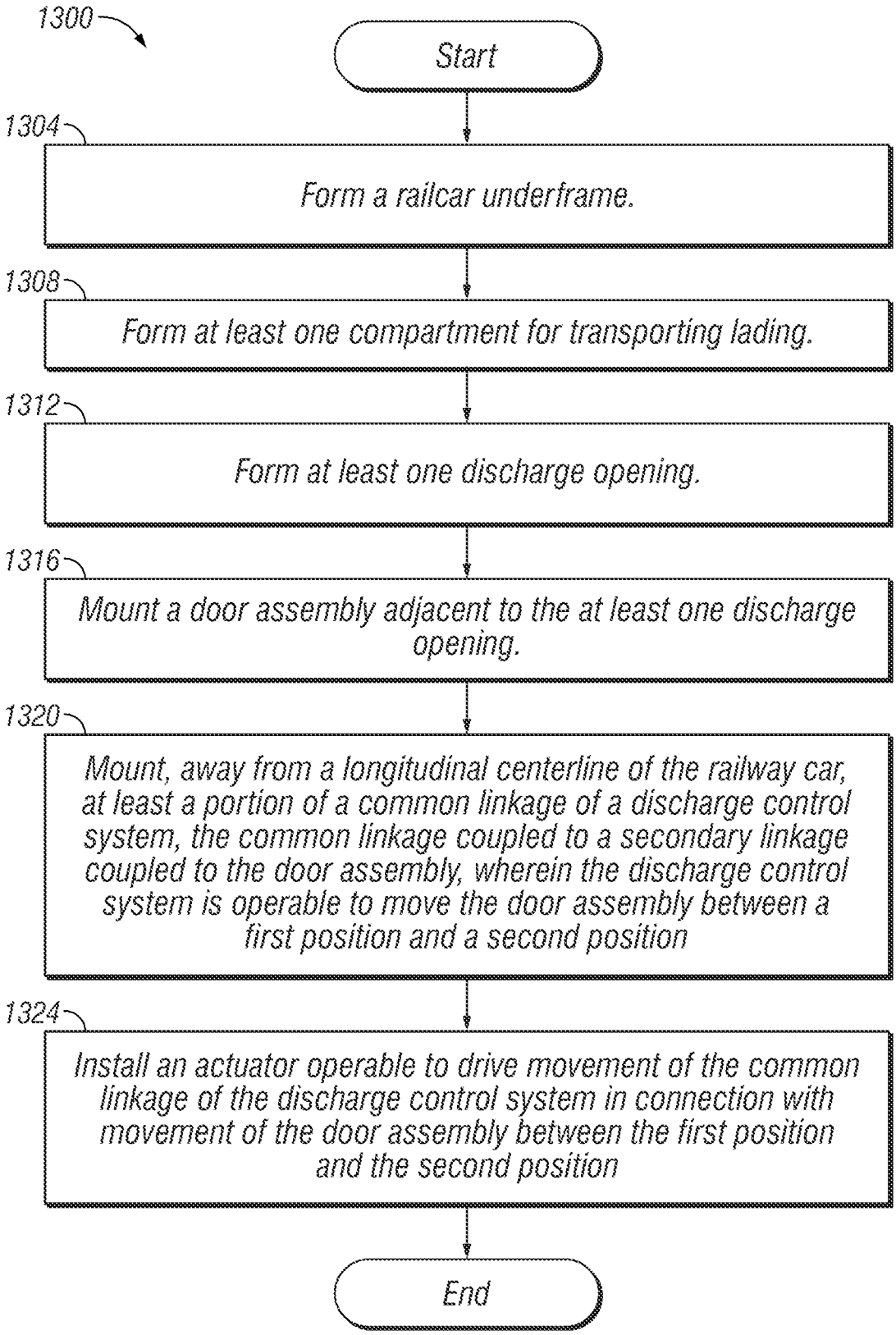
FIG. 13 is a flow diagram of a method of forming a railway car, in accordance with certain embodiments.

FIG. 13 is a flow chart of a method 1300 of forming a railcar, in accordance with certain embodiments. Method 1300 begins at step 1304, where a railway underframe is formed. At step 1308, at least one compartment for transporting lading is formed. At step 1312, at least one discharge opening is formed.

At step 1316, a door assembly is mounted adjacent to the at least one discharge opening. At step 1320, at least a portion of a common linkage of a discharge control system is mounted away from a longitudinal centerline of the railway car. The common linkage is coupled to a secondary linkage coupled to the door assembly. The discharge control system is operable to move the door assembly between a first position and a second position.

At step 1324, an actuator operable to drive movement of the common linkage of the discharge control system in connection with movement of the door assembly between the first position and the second position is installed. In certain embodiments, installing the actuator operable to drive movement of the common linkage of the discharge control system in connection with movement of the door assembly between the first position and the second position may comprise mounting the actuator on one or more of: a side sill of the railway car; a sidewall assembly of the railway car; a top chord of the railway car. In certain embodiments, the actuator may be one of: a hydraulic actuator; a pneumatic actuator, and a manual actuator.

In certain embodiments, the underframe may comprise a side sill oriented parallel to a longitudinal axis of the railway car. The at least one compartment for transporting lading may comprise at least one hopper. The at least one discharge opening may be formed proximate to a lower portion of the at least one hopper. The common linkage may be mounted to the side sill. In certain embodiments, the common linkage may comprise a torque tube, and the actuator may be operable to rotate the torque tube in a clockwise direction relative to a longitudinal axis of the torque tube and in a counterclockwise direction relative to the longitudinal axis of the torque tube. In certain embodiments, the common linkage may comprise a sliding beam, and the actuator may be operable to push the sliding beam relative to the longitudinal axis of the railway car and pull the sliding beam relative to the longitudinal axis of the railway car.

In certain embodiments, the method may further comprise forming at least one sidewall assembly coupled to the underframe. The at least one discharge opening may be formed in the at least one sidewall assembly. The common linkage may be mounted proximate to a top chord coupled to the at least one sidewall assembly. In certain embodiments, the common linkage may comprise a torque tube, and the actuator may be operable to rotate the torque tube in a clockwise direction relative to a longitudinal axis of the torque tube and in a counterclockwise direction relative to the longitudinal axis of the torque tube. In certain embodiments, the common linkage may comprise a sliding beam, and the actuator may be operable to push the sliding beam relative to the longitudinal axis of the railway car and pull the sliding beam relative to the longitudinal axis of the railway car.

Modifications, additions, or omissions may be made to the systems and apparatuses described herein without departing from the scope of the disclosure. The components of the systems and apparatuses may be integrated or separated. Moreover, the operations of the systems and apparatuses may be performed by more, fewer, or other components. Additionally, operations of the systems and apparatuses may be performed using any suitable logic comprising software, hardware, and/or other logic. As used in this document, "each" refers to each member of a set or each member of a subset of a set.

Modifications, additions, or omissions may be made to the methods described herein without departing from the scope of the disclosure. The methods may include more, fewer, or other steps. Additionally, steps may be performed in any suitable order.

Although this disclosure has been described in terms of certain embodiments, alterations and permutations of the embodiments will be apparent to those skilled in the art. Accordingly, the above description of the embodiments does not constrain this disclosure. Other changes, substitutions, and alterations are possible without departing from the spirit and scope of this disclosure.

The invention claimed is:

1. A railway car, comprising:

an underframe, the underframe comprising a side sill oriented parallel to a longitudinal axis of the railway car and positioned proximate to a lower portion of the railway car;

at least one sidewall assembly coupled to the underframe;

at least one compartment for transporting lading;

at least one discharge opening;

a door assembly adjacent to the at least one discharge opening;

a discharge control system comprising at least a common linkage and a secondary linkage, wherein:

the discharge control system is operable to move the door assembly between a first position and a second position; and the common linkage of the discharge control system is mounted to the railway car using at least one hangar support, wherein the hangar support is shaped to allow at least one of rotation of the common linkage within the hangar support and movement of the common linkage parallel to longitudinal axis of the railway car.

2. The railway car of claim 1, wherein:

the door assembly comprises at least one door hinge;

the door hinge is mounted to the railway car using the at least one hangar support; and the hangar support is shaped to allow rotation of the door hinge within the hangar support.

3. The railway car of claim 1, wherein:

the at least one compartment for transporting lading comprises at least one hopper;

the at least one discharge opening is formed proximate to a lower portion of the at least one hopper; and the common linkage of the discharge control system is mounted to the side sill of the railway car using the at least one hangar support.

4. The railway car of claim 3, wherein the hangar support is mounted to the side sill of the railway car and a bottom slope sheet of the railway car.

5. The railway car of claim 3, wherein the hangar support is mounted to a base plate coupled to the side sill.

6. The railway car of claim 3, wherein:

the common linkage comprises a torque tube;

the torque tube is positioned within a torque tube support and substantially surrounded by a bushing;

the torque tube is mounted to the underside of the side sill using the hangar support; and the hangar support is shaped to allow rotation of the torque tube within the hangar support.

7. The railway car of claim 3, wherein:

the common linkage comprises a sliding beam;

the sliding beam is mounted to the underside of the side sill using the hangar support; and the hangar support is shaped to allow movement of the sliding beam parallel to the longitudinal axis of the railway car.

8. The railway car of claim 1, wherein:

the at least one discharge opening is formed in the at least one sidewall assembly; and the common linkage of the discharge control system is mounted proximate to a top chord coupled to the least one sidewall assembly.

9. The railway car of claim 8, wherein:

the common linkage comprises a torque tube;

the torque tube is positioned within a torque tube support and substantially surrounded by a bushing;

the torque tube is mounted proximate to the top chord using the hangar support; and the hangar support is shaped to allow rotation of the torque tube within the hangar support.

10. The railway car of claim 8, wherein:

the common linkage comprises a sliding beam;

the sliding beam is mounted proximate to the top chord using the hangar support; and the hangar support is shaped to allow movement of the sliding beam parallel to the longitudinal axis of the railway car.

11. The railway car of claim 1, further comprising an actuator operable to drive movement of the common linkage in connection with movement of the door assembly between the first position and the second position.

12. A railway car, comprising:

an underframe, the underframe comprising a side sill oriented parallel to a longitudinal axis of the railway car and positioned proximate to a lower portion of the railway car;

at least one sidewall assembly coupled to the underframe;

at least one compartment for transporting lading;

at least one discharge opening;

a door assembly adjacent to the at least one discharge opening, the door assembly comprising at least one door hinge;

a discharge control system comprising at least a common linkage and a secondary linkage, wherein:

the discharge control system is operable to move the door assembly between a first position and a second position; and the common linkage of the discharge control system and the door hinge are mounted to the railway car using at least one hangar support, wherein the hangar support is shaped to allow rotation of the door hinge within the hangar support and allow at least one of rotation of the common linkage within the hangar support and movement of the common linkage parallel to longitudinal axis of the railway car.

13. The railway car of claim 12, wherein:

the at least one compartment for transporting lading comprises at least one hopper;

the at least one discharge opening is formed proximate to a lower portion of the at least one hopper; and the common linkage of the discharge control system is mounted to the side sill of the railway car using the at least one hangar support.

14. The railway car of claim 13, wherein the hangar support is mounted to the side sill of the railway car and a bottom slope sheet of the railway car.

15. The railway car of claim 13, wherein the hangar support is mounted to a base plate coupled to the side sill.

16. The railway car of claim 13, wherein:

the common linkage comprises a torque tube;

the torque tube is positioned within a torque tube support and substantially surrounded by a bushing;

the torque tube is mounted to the underside of the side sill using the hangar support; and the hangar support is shaped to allow rotation of the torque tube within the hangar support.

17. The railway car of claim 13, wherein:

the common linkage comprises a sliding beam;

the sliding beam is mounted to the underside of the side sill using the hangar support; and the hangar support is shaped to allow movement of the sliding beam parallel to the longitudinal axis of the railway car.

18. The railway car of claim 12, wherein:

the at least one discharge opening is formed in the at least one sidewall assembly; and the common linkage of the discharge control system is mounted proximate to a top chord coupled to the least one sidewall assembly.

19. The railway car of claim 18, wherein:

the common linkage comprises a torque tube;

the torque tube is positioned within a torque tube support and substantially surrounded by a bushing;

the torque tube is mounted proximate to the top chord using the hangar support; and the hangar support is shaped to allow rotation of the torque tube within the hangar support.

20. The railway car of claim 18, wherein:

the common linkage comprises a sliding beam;

the sliding beam is mounted proximate to the top chord using the hangar support; and the hangar support is shaped to allow movement of the sliding beam parallel to the longitudinal axis of the railway car.

21. The railway car of claim 12, further comprising an actuator operable to drive movement of the common linkage in connection with movement of the door assembly between the first position and the second position.

* * * * *